United States Patent [19]

Gorin

[11] 3,946,652

[45] Mar. 30, 1976

[54] DISPENSING SPOON

[76] Inventor: Sylvan Gorin, 728 Chelten Ave., Philadelphia, Pa. 19126

[22] Filed: Aug. 6, 1974

[21] Appl. No.: 491,972

[52] U.S. Cl. ..... 99/323; 99/295; 426/77

[51] Int. Cl.[2] ..... A47G 19/16

[58] Field of Search..... 99/323, 295, 320, 321–322, 99/317–318, 279; 30/324–325, 326–327, 328; 206/216, 219, 820; 239/33; 426/77, 82, 84–85, 86; 100/110

[56] References Cited

UNITED STATES PATENTS

| | | | |
|---|---|---|---|
| 214,617 | 4/1879 | Brown | 239/33 |
| 382,870 | 5/1888 | Farrington | 99/323 X |
| 829,652 | 8/1906 | Johnson | 99/323 UX |
| 1,367,568 | 2/1921 | Smith | 99/323 |
| 2,092,510 | 9/1937 | Haut | 99/295 UX |
| 3,154,418 | 10/1964 | Lovell et al. | 30/326 X |
| 3,252,803 | 5/1966 | Belasco | 426/86 X |

FOREIGN PATENTS OR APPLICATIONS

| | | | |
|---|---|---|---|
| 21,718 | 10/1899 | United Kingdom | 99/323 |

*Primary Examiner*—Billy J. Wilhite
*Assistant Examiner*—Arthur O. Henderson
*Attorney, Agent, or Firm*—Caesar, Rivise, Bernstein & Cohen

[57] ABSTRACT

A spoon for individually brewing a beverage upon immersion and subsequent stirring of the spoon within a liquid, such as water. The spoon comprises a handle portion and a bowl portion having an upper wall and a bottom wall spaced therefrom. The walls define a hollow compartment therebetween, which compartment is prefilled with a dry, beverage-making ingredient, such as instant coffee. A plurality of apertures are provided in the bottom wall of the spoon to enable the infusion of the beverage-making ingredient into the liquid when the spoon is disposed within the liquid. The top wall of the bowl is unapertured so that the spoon may retain its function as a device for sipping, ladling, etc.

6 Claims, 8 Drawing Figures

DISPENSING SPOON

This invention relates generally to prefilled disposable devices for preparation of various types of beverages such as coffee, tea, soup, etc. and more particularly relates to disposable spoons having a beverage-making ingredient prefilled therein for brewing an individual portion of a beverage.

It is frequently desirable to brew an individual portion of a beverage, such as coffee, tea, soup, etc., without necessitating the use of conventional brewing equipment, such as coffee pots, tea pots, etc. Accordingly, various prefilled utensils for brewing a beverage without requiring anything other than hot water have been disclosed in the patent literature. For example, see the U.S. Pat. Nos. 790,626 (French), 1,489,806 (Anderson), 2,123,054 (Lamb et al), Re 21,338 (Haut), and 3,428,460 (Ely). However, there presently exists no commercially viable prefilled brewing implement since such prior art devices suffer from various drawbacks, e.g. complexity, size, efficiency, expense, etc.

In the U.S. Pat. No. 3,154,418 (Lovell et al.) there is disclosed a package and stirring implement for making individual portions of beverages which overcome some of the aforenoted disadvantages of the prior art. To that end, one of the embodiments disclosed by Lovell et al. is in the form of a spoon having a pair of compartments therein, one compartment being in the bowl of the spoon and the other within the handle. The bowl includes a top wall and a bottom wall spaced therefrom, with the spoon compartment being defined therebetween. The spoon compartment is adapted for holding a dry beverage-making ingredient, such as instant coffee, therein. A plurality of apertures are provided within the top wall of the bowl to permit the ingress of liquid therein when the spoon is immersed in a cup of water, such that the beverage-making ingredient may dissolve in the water to produce the desired beverage.

While the device of Lovell et al. may be appropriate for its intended function, that is for producing a beverage by the introduction of the device into a liquid and the subsequent stirring therein, the device of Lovell et al. suffers from a major deficiency. Such a deficiency centers around the fact that the spoon of Lovell et al. is incapable of performing in any manner akin to a conventional spoon to enable one to use the spoon for sipping, tasting or ladling. The device of Lovell et al., notwithstanding its spoon-shape, is a mere stirring device and not a spoon.

It is a general object of this invention to provide a dispensing spoon which overcomes the various disadvantages of the prior art.

It is a further object of this invention to provide a spoon having a beverage-making ingredient prefilled therein and capable of ready release into a liquid in which the spoon is disposed and stirred, with the spoon retaining its ability to function as a feeding implement.

It is still a further object of this invention to provide a disposable, beverage-dispensing spoon, which is simple in construction and can be made readily and inexpensively.

These and other objects of this invention are achieved by providing a disposable dispensing spoon for brewing a beverage when the spoon is immersed within a liquid. The spoon comprises an elongated handle terminating in a bowl-shaped portion. The bowl-shaped portion includes a concave upper wall and a bottom wall spaced therefrom and defining a compartment therebetween. A dry, beverage-making ingredient is disposed within the compartment. The bottom wall of the bowl-shaped portion has plural apertures therein to permit the free flow of liquid into and out of the compartment to effect the brewing of the beverage. The top wall of the bowl is unapertured to enable the brewed beverage to be held within the bowl-shaped portion for sipping therefrom.

Other objects and many of the attendant advantages of this invention will be readily appreciated as the same becomes better understood by reference to the following detailed description when considered in connection with the accompanying drawing wherein.

Figure 1:
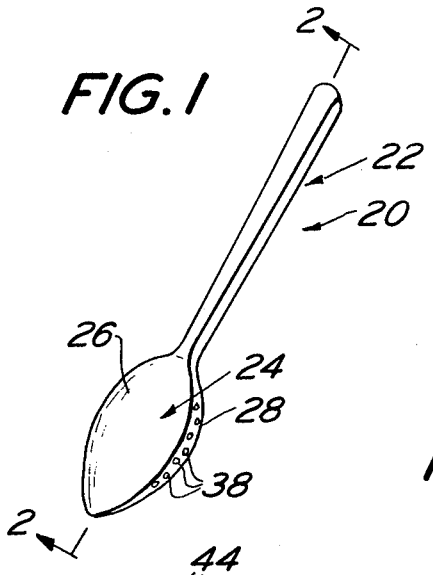
FIG. 1 is a perspective view of a spoon in accordance with one embodiment of this invention.

Referring now in greater detail to the various figures of the drawing wherein like reference characters refer to like parts, there is shown in FIG. 1 a dispensing utensil or spoon 20 in accordance with one aspect of this invention. As will be seen later, the spoon 20 includes a charge of a dry, powdered or granulated, beverage-making ingredient, such as instant coffee, therein, which ingredient is released from the spoon to effect the brewing of the beverage when the spoon is disposed and stirred within a liquid, such as hot water. Owing to the particular construction of the spoon 20, the feature of the spoon is retained to enable one to use the spoon in a conventional manner for feeding, tasting, sipping, ladling, etc.

In accordance with all of the preferred embodiments of the invention, the spoon is intended as a disposable device, that is, it is used once to brew the beverage and aid in the tasting or sipping thereof and thereafter is discarded.

The spoon of this invention has wide utility in applications wherein it is desired to brew individual portions of the beverage when all that is available is hot water. Accordingly, such spoons are particularly useful in camping or picnic applications, in industrial applications such as factory assembly lines, in commercial applications, such as offices, waiting rooms, lobbies, in hospitals and nursing homes or other applications wherein kitchens are closed but hot water is available.

Figure 2:
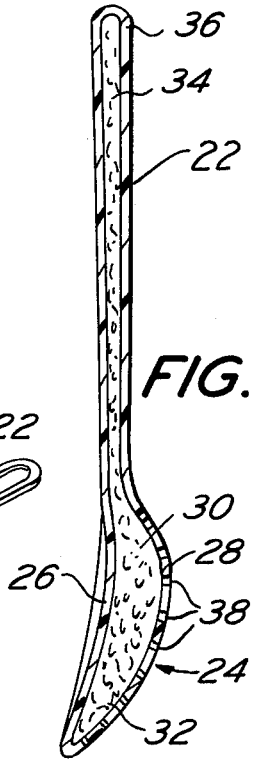
FIG. 2 is an enlarged sectional view taken along line 2—2 of FIG. 1.

As can be seen in FIG. 1, spoon 20 basically comprises an elongated handle 22 terminating in a bowl-shaped portion 24. As best seen in FIGS. 1 and 2, the bowl-shaped portion includes an upper and a lower or bottom wall. The upper wall 26 is generally concave and serves to form a bowl which is adapted for holding a liquid therein. The size or capacity of the bowl formed by upper wall 26 is open to choice, but is preferably dimensioned so as to accommodate either a teaspoon or a tablespoon volume therein.

The lower wall 28 is also concave in shape, but is slightly deeper than wall 26 and is spaced therefrom to define a compartment 30 therebetween. The compartment is adapted for holding a dry, powdered or granulated, beverage-making ingredient 32 (See FIG. 2), such as instant coffee, tea, cocoa, soup, etc., therein.

In the embodiment shown in FIGS. 1 and 2, the charging of the ingredient 32 in cavity 30 of spoon 20 is effected via handle 22. To that end handle 22 is a hollow member having a central passageway 34 communicating with compartment 30. At the free end 36 of the spoon there is provided an opening (not shown) through which the ingredient 32 is introduced into passageway 34 and from there to communicating compartment 30. Once the spoon is sufficiently charged, which may be either a full or partial charge of the compartment 30 and associated communicating passageway 34, the opening in the free end of the spoon is sealed or nipped shut such as by a hot blade to seal the charge within the spoon.

As can be seen in FIGS. 1 and 2 the bottom wall 28 of spoon includes a plurality of perforations or apertures 38 therein. The apertures 38 permit the free flow of liquid into and out of compartment 30 when the spoon is immersed within a liquid. This action permits the infusion of the beverage-making ingredient into the liquid to thereby effect the brewing of the beverage. As will be appreciated by those skilled in the art, the size of the apertures 38 are made large enough to permit the free passage of water into and out of compartment 30 when the spoon is disposed within water, yet are sufficiently small so as to preclude with particles of the dry, beverage-making ingredient from falling out of the compartment prior to the immersion of the spoon within the water.

As can be seen clearly in FIGS. 1 and 2 the top wall 26 of the bowl-shaped portion 24 of the spoon is unapertured. This feature is of considerable importance in that the bowl produced by the concave surface is capable of use in the same manner as a conventional spoon. To that end, the spoon 20, even after use in brewing the beverage, can be used as a conventional spoon to enable the brewed beverage to be held within the bowl-shaped portion of sipping of the contents therefrom.

Figure 3:
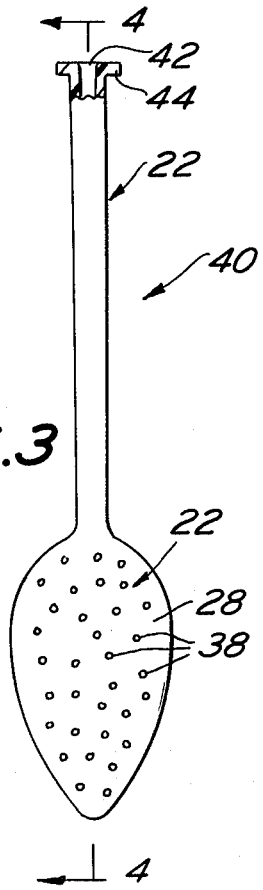
FIG. 3 is an elevational view, partially in section, of the underside of an alternative embodiment of this invention.
Figure 4:
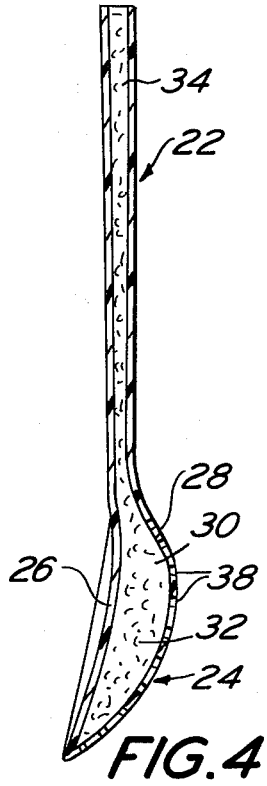
FIG. 4 is a sectional view taken along line 4—4 of FIG. 3.
Figure 5:
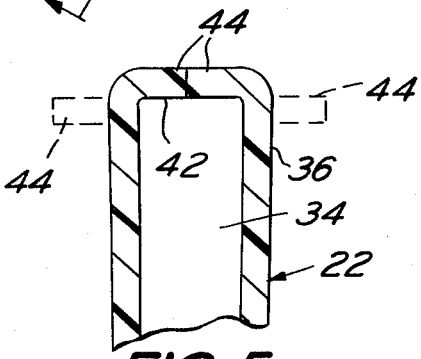
FIG. 5 is an enlarged sectional view of the end of the handle portion of the embodiment of the invention shown in FIG. 3.

In FIGS. 3 – 5 there is shown another embodiment of the spoon of this invention. As can be seen therein, spoon 40 is similar in construction to spoon 20 that includes handle 22 and bowl protion 24. The bowl portion 24 includes upper wall 26 (FIG. 4) and lower wall 28 spaced therefrom and defining compartment 30 therebetween, in which compartment is disposed a dry, beverage-making ingredient 32. The bottom wall 28 includes plural openings or apertures 38 through which liquid may enter and leave compartment 30.

As can be seen in FIG. 3 the free end 36 of handle 22 includes an opening 42 therein and communicating with longitudinal passageway 34 (see FIG. 4). The opening 42 serves as the passageway through which the dry, beverage-making ingredient 32 is introduced into the spoon.

A pair of ears or flaps 44 project normally from the free end 36 of the handle immediately adjacent opening 42. Once the spoon 40 is charged with ingredient 32, flaps 44 are bent from the position shown in FIG. 3 and the phantom line position shown in FIG. 5 to the closed or solid line position shown in FIG. 5. As can be seen therein, in the closed position the flaps 44 are bent back so as to close the opening 42 and thereby seal the charge of the beverage-making ingredient within the spoon.

In addition to the sealing function provided by the flaps 44, the flaps also serve a significant function during the manufacture of the spoon. To that end, during the charging of plural spoons along a high-speed loading line, the flaps 44 serve as means for hanging the spoons between a pair of guide rails on a track during the loading process. Once the loading of the spoons is complete the flaps are closed in a manner heretofor described.

Figure 6:
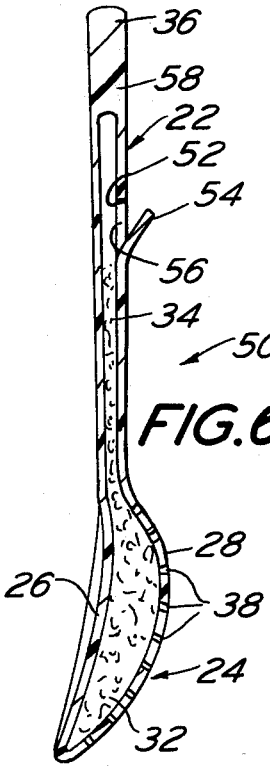
FIG. 6 is a sectional view, similar to the view of FIG. 2, but of yet another alternative embodiment of this invention.

In FIG. 6 there is shown yet another embodiment, 50, of a dispensing spoon in accordance with this invention. The spoon 50 is of similar construction to spoons 20 and 40 heretofore described. To that end, spoon 50 includes an elongated handle 22 terminating in a bowl-shaped portion 24. The bowl-shaped portion includes concave upper wall 26 and a lower wall 28, spaced from wall 26 and forming a compartment 30 therebetween. A charge of a dry, beverage-making ingredient 32 is disposed within compartment 30 and is adapted to be introduced into a liquid in which the spoon is disposed through plural communicating apertures 38 in bottom wall 28.

While spoons 20 and 40 are filled through openings provided in the free end 36 of their respective handles, the handle of spoon 50 is solid adjacent its free end 36 and hence does not serve as the means for effecting the charging of the spoon. Instead, filling means are provided at an intermediate point in the handle. To that end such means comprise a slit 52, which is preferably arcuate in shape and which defines a flap 54 therein. The flap 54 is adapted to be sent out of the plane of the portion of the handle contiguous therewith to provide an opening 56 through which the dry ingredient 32 may be introduced into the spoon.

All of the heretofor described embodiments of the spoon of this invention are formed as a one-piece construction. To that end, spoons 20, 40 and 50 are molded from a suitable plastic material by conventional molding techniques, such as vacuum or blow molding.

In order to more securely seal the charge of ingredient 32 within the spoon, in the event that the entire hollow interior of the spoon is not filled, the handle portion of the spoon may be pinched or nipped closed at an intermediate point corresponding to the level of the ingredient 32 in passageway 34. However, it should be appreciated that by utilizing the entire hollow interior of the spoon to hold the beverage-making ingredient, one could produce a spoon with a relatively small compartment 30, thereby increasing the attractiveness and decreasing the expense of the spoon.

It is contemplated that if the handle of the spoon is used to hold a portion of the ingredients 30 therein additional apertures may be provided within the handle to effect rapid dissolution of such ingredients into the liquid. However, such openings may not be required in view of the fact that the ingredient such as coffee in the handle will readily dissolve due to the capillary action of the liquid through passageway 34. If this ingredient is more difficult to dissolve, apertures should be included on reverse side of the handle.

Figure 7:
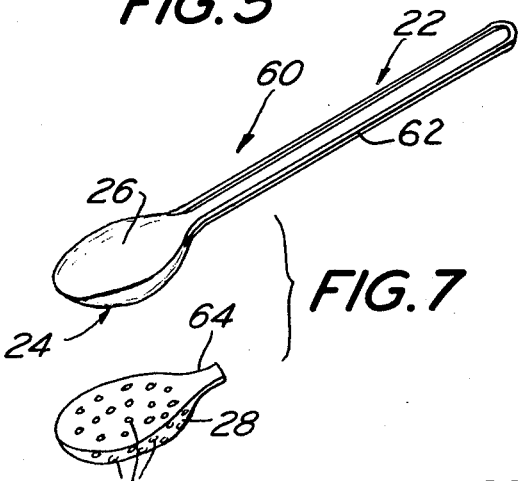
FIG. 7 is an exploded perspective view of another embodiment of this invention.
Figure 8:
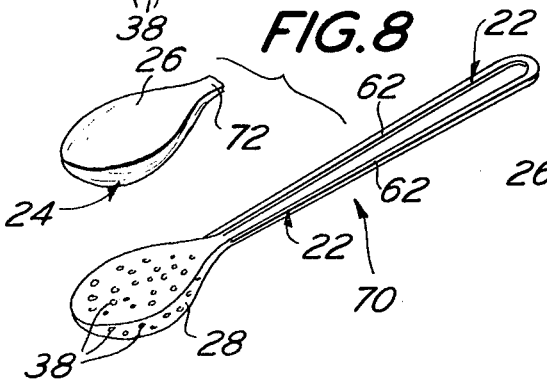
FIG. 8 is an exploded perspective view of still another embodiment of this invention.

In FIGS. 7 and 8 there is shown further alternative embodiments of the spoon of this invention. In those embodiments the spoons are formed as a two-pice construction.

For example, in FIG. 7 there is shown a spoon 60 comprising an elongated handle 22 terminating in a bowl-shaped portion 24. The bowl-shaped portion 24 consists of a concave upper wall 26 and an even more concave lower or bottom wall 28. The upper wall 26 is formed integrally with handle 22. The lower wall 28 is adapted to be secured to the upper wall so as to define a space or compartment 30 therebetween. In accordance with the preferred embodiment of this invention the securement of the upper and lower walls to each other is effected by snap-fitting the lower wall to the upper wall. The lower wall includes a plurality of apertures 38 therein. A charge of a dry, beverage-making ingredient 32 is disposed within the lower wall and then the lower wall is snapped fit to the upper wall to form the compartment and to enclose the ingredients within said compartment.

As in all of the heretofor described embodiments of this invention, the upper wall 26 of the spoon is unapertured so as to enable the spoon to serve in a conventional manner as a sipping or ladling device.

As can be seen in FIG. 7 the handle of spoon 60 includes a pair of longitudinally extending ribs 62. The ribs not only serve to stiffen the handle 22, but also serve as the means for aligning the two walls forming the bowl 24. To that end, the neck portion 64 of the lower wall portion 28 is adapted to be disposed between the ribs 62 on the underside of the spoon.

In FIG. 8 there is shown an embodiment 70 of the spoon of this invention which is similar to the spoon 60 shown in FIG. 7, but wherein the handle 22 is formed integrally with the lower wall 28, with the upper wall 26 snapped fit thereto. Like spoon 60, spoon 70 includes longtudinally extending ribs 62 in the handle which serve to stiffen the handle while effecting the securement of the upper wall to the bottom wall by aligning the neck 72 of the upper wall between the ribs on the top side of the handle.

It should be appreciated from the foregoing, the spoons of this invention, are simple in construction, can be made quickly and inexpensively, are sanitary, are effective for brewing individual portions of a beverage with necessitating the use of anything other than a hot liquid, yet maintain complete functional ability to serve as a sipping or ladling device.

Without further elaboration, the foregoing will so fully illustrate my invention that others may, by applying current or future knowledge, readily adapt the same for use under various conditions of service.

What is claimed as the invention is:

1. A disposable dispensing spoon for brewing a beverage when the spoon is immersed within a liquid, said spoon comprising an elongated handle having a hollow portion and terminating in a bowl-shaped portion, said bowl-shaped portion including a concave upper wall and a bottom wall spaced slightly therefrom and defining a compartment therebetween and in communication with said hollow portion of said handle, a dry, beverage-making ingredient being disposed within said compartment and said hollow portion of said handle, said bottom wall of the bowl portion having plural apertures therein large enough to permit the free flow of liquid into and out of said compartment when said spoon is immersed in a liquid yet sufficiently small so as to preclude said dry beverage-making ingredient from falling out of said apertures, said upper wall of the bowl being unapertured to enable said brewed beverage to be held within the bowl-shaped portion for sipping therefrom.

2. The spoon of claim 1 wherein means are provided in said handle for filling said compartment with said dry, beverage-making ingredient.

3. The spoon of claim 2 wherein said handle includes the free end and wherein said means comprises an opening which is nipped shut after the compartment within the spoon is filled with the beverage-making ingredient.

4. The spoon of claim 3 wherein said spoon is formed as an integral unit of a plastic material.

5. The spoon of claim 2 wherein said means includes a slit forming a window in said handle, and a flap disposed within said window, said flap being slightly pivotable out of said window to enable the dry, beverage-making ingredient to be introduced through said window and into the interior of said compartment.

6. The spoon of claim 5 wherein said spoon is formed as an integral unit of a plastic material.

* * * * *